US005801481A

United States Patent [19]

Yokota

[11] Patent Number: 5,801,481

[45] Date of Patent: Sep. 1, 1998

[54] CATHODE RAY TUBE

[75] Inventor: Masahiro Yokota, Kumagaya, Japan

[73] Assignee: Kabushiki Kaisha Toshiba, Kawasaki, Japan

[21] Appl. No.: 845,467

[22] Filed: Apr. 25, 1997

[30] Foreign Application Priority Data

Apr. 26, 1996 [JP] Japan ..... 8-107415

[51] Int. Cl.[6] ..... H01J 29/70

[52] U.S. Cl. ..... 313/440; 335/213; 335/296

[58] Field of Search ..... 313/440, 296, 313/299, 213, 210

[56] References Cited

U.S. PATENT DOCUMENTS

| | | | |
|---|---|---|---|
| 3,731,129 | 5/1973 | Tsuneta et al. . | |
| 5,138,290 | 8/1992 | Togane et al. | 313/440 X |
| 5,453,658 | 9/1995 | Nishino et al. | 335/213 X |
| 5,519,281 | 5/1996 | Jamar | 335/213 X |
| 5,592,045 | 1/1997 | Dossot et al. | 313/440 |
| 5,598,055 | 1/1997 | Ioune et al. | 313/440 |
| 5,637,955 | 6/1997 | Ji | 335/213 X |

FOREIGN PATENT DOCUMENTS

| | | |
|---|---|---|
| 48-34349 | 10/1973 | Japan . |
| 48-85030 | 11/1973 | Japan . |
| 4-184845 | 7/1992 | Japan . |

*Primary Examiner*—Ashok Patel

*Attorney, Agent, or Firm*—Cushman Darby & Cushman IP Group of Pillsbury Madison & Sutro LLP

[57] ABSTRACT

A deflection yoke is provided on the outer surface of a boundary region between a neck and a cone of a funnel of a vacuum envelope. The deflection yoke includes a separator having one end portion, smaller in diameter, and the other end portion, larger in diameter, and a deflecting coil is attached to the inner surface of the separator. The inner surface of the separator is shaped so that its one end portion is circular and its other end portion is substantially rectangular. A plurality of first and second hooks and channels defined between the hooks are arranged on the one and the other end portions, respectively, of the inner surface of the separator. A winding of the deflecting coil is wound around the first and second hooks so as to be fitted in the channels. Third hooks for preventing the winding from being lifted are located on those parts of the inner surface of the separator whose cross sections have a minimum radius of curvature.

4 Claims, 4 Drawing Sheets

CATHODE RAY TUBE

BACKGROUND OF THE INVENTION

The present invention relates to a cathode ray tube provided with a deflection yoke.

In general, a cathode ray tube comprises a vacuum envelope that includes a substantially rectangular face panel and a funnel. One end portion of the funnel is formed of a cylindrical small-diameter neck, while the other end portion is formed of a large-diameter cone that has a substantially rectangular sectional shape corresponding to the external shape of the face panel. A phosphor screen is formed on the inner surface of the face panel, and an electron gun is disposed in the neck of the funnel. In this cathode ray tube, moreover, a deflection yoke is attached to the outside of a region near the boundary between the neck and the cone of the funnel. Electron beams emitted from the electron gun are deflected by means of magnetic fields generated by the deflection yoke, and are used to scan the phosphor screen horizontally and vertically, thereby displaying an image.

A color cathode ray tube uses an electron gun that can emit three electron beams. After the three electron beams emitted from the electron gun are deflected by means of magnetic fields that are generated by the deflection yoke, they are screened by means of a shadow mask and projected on a phosphor screen formed of phosphor layers of three different colors.

The deflection yoke generally comprises a plastic separator mounted on the funnel and horizontal and vertical deflecting coils attached to the separator. Since the deflection yoke entails substantial power consumption, deflection power for the cathode ray tube is made lower than in the conventional case.

Described in Jpn. Pat. Appln. KOKOKU Publication No. 48-34349, for example, is a specific arrangement of means for lowering the deflection power. In this arrangement, the cross-sectional shape of the region near the boundary between the neck and the cone of the funnel, which usually is circular, gradually changes from a circular shape on the neck side into a substantially rectangular shape, similar to the external shape of the face panel, on the cone side. Described in Jpn. Pat. Appln. KOKAI Publication No. 48-85030, moreover, is an arrangement in which the sectional shape of the inner surface of the deflection yoke gradually changes from a circular shape on the neck side into a substantially rectangular shape on the cone side, corresponding to the shape of the region near the boundary between the neck and the cone of the funnel.

According to this arrangement, the deflecting coils of the deflection yoke located around the boundary between the neck and the cone can be brought close to the paths of the electron beams at the respective ends of the horizontal and vertical axes of the cathode ray tube, and the deflection power for the deflection yoke can be made lower than that for an ordinary deflection yoke with a circular cross section.

Modern cathode ray tubes are widely used in terminal display units of computers and other OA apparatuses, as well as in TV receiver sets. The cathode ray tubes in the display units, in particular, are expected to be able to display high-precision images.

Generally, a cathode ray tube forms horizontal scanning lines by horizontally deflecting electron beams at a high line frequency, and displays images by vertically deflecting the beams at a low screen frequency. In consideration of flickering of the screen, the screen frequency is adjusted to about 60 to 80 Hz. In order to enhance the precision of the displayed images, therefore, the line frequency must be raised.

In order to ensure the high line frequency, it is necessary to lower the inductance of the horizontal deflecting coils of the deflection yoke. In the deflection yoke of a cathode ray tube used in a terminal display unit of an OA apparatus such as a computer, therefore, the inductance of the horizontal deflecting coils is reduced to as low a level as about 100 μH. This reduction is equivalent to a reduction of about 30 turns of a deflecting coil. Thus, in the low-inductance deflection yoke, a deflection current flow through each coil winding is so large that the winding must be thickened. In the case where thick windings are used, however, the image characteristics vary, arousing a problem, if the windings are dislocated to a minimum degree with respect to the separator.

An example of means for preventing such dislocation of the windings of the low-inductance deflection yoke is described in Jpn. Pat. Appln. KOKAI Publication No. 4-184845. According to this preventive means, a plurality of slits are formed on the inner surface of the separator, and the respective positions of the windings of the horizontal deflecting coils inside the separator are regulated by coiling the windings along the slits. The deflection yoke of this type can restrain dislocation of the windings more effectively than a deflection yoke that is provided with conventional molded deflecting coils.

If this arrangement is applied to a deflection yoke with a separator that has an inner surface of which the sectional shape gradually changes from a circular shape on the neck side into a substantially rectangular shape on the cone side, however, the windings that extend across the corner portions of the inner surface of the separator having the substantially rectangular cross section may possibly be lifted off the inner surface, since regions near the corner portions have a generous curvature. In case the windings are lifted and deviated from their predetermined positions, the image characteristics of the cathode ray tube lower inevitably.

BRIEF SUMMARY OF THE INVENTION

The present invention has been contrived in consideration of these circumstances, and its object is to provide a cathode ray tube wherein a deflection yoke is capable of preventing a winding of a deflecting coil from being lifted, thereby improving the image characteristics.

In order to achieve the above object, a cathode ray tube according to the invention comprises an envelope including a face panel having a substantially rectangular effective portion and a funnel fixed to the face panel, the funnel having a cylindrical small-diameter neck at one end portion thereof and a large-diameter cone at the other end portion, the cone having a substantially rectangular cross-sectional shape corresponding to the external shape of the face panel; and a deflection yoke including a trumpet-shaped separator having one end portion, smaller in diameter, and the other end portion, larger in diameter, and a deflecting coil provided at least on the inner surface of the separator, the deflection yoke being mounted on a region near the boundary between the neck and the cone of the funnel.

The region near the boundary between the neck and the cone of the funnel is shaped so that the external shape thereof gradually changes from a circular shape on the neck side into a substantially rectangular shape on the cone side. The separator includes the inner surface having a shape resembling the external shape of the region near the boundary between the neck and the cone of the funnel so that the cross-sectional shape of the inner surface is circular at the one end portion of the separator and noncircular at the other end portion and gradually changes from the circular shape on the one end side into the noncircular shape on the other end side; a plurality of first hooks arranged on the inner surface at the one end portion and extending in a direction substantially in parallel to a central axis of the separator; and a plurality of second hooks provided on the inner surface at the other end portion, directed toward the other end of the separator, and extending away form the center axis of the separator. The deflecting coil includes a winding mounted on the inner surface of the separator so as to be wound around the first and second hooks. The separator includes third hooks located on those parts of the inner surface thereof in which the cross section of the noncircular portion has a minimum radius of curvature and adapted to engage those parts of the winding of the deflecting coil which extend across regions having the minimum radius of curvature, thereby preventing the winding from being lifted off the inner surface of the separator.

Additional objects advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 7 show a color cathode ray tube according to an embodiment of the present invention, in which:

FIG. 1 is a plan view, partially in section, showing the color cathode ray tube;

FIG. 2 is a side view, partially in section, showing a deflection yoke;

FIG. 4 is a front view of a separator of the deflection yoke;

FIG. 5 is a side view, partially in section, showing the separator;

FIG. 6 is a sectional view taken along line VI—VI of FIG. 5; and

FIG. 7 is a sectional view taken along line VIII—VIII of FIG. 4.

DETAILED DESCRIPTION OF THE INVENTION

A color cathode ray tube according to an embodiment of the present invention will now be described in detail with reference to the accompanying drawings.

Figure 1:
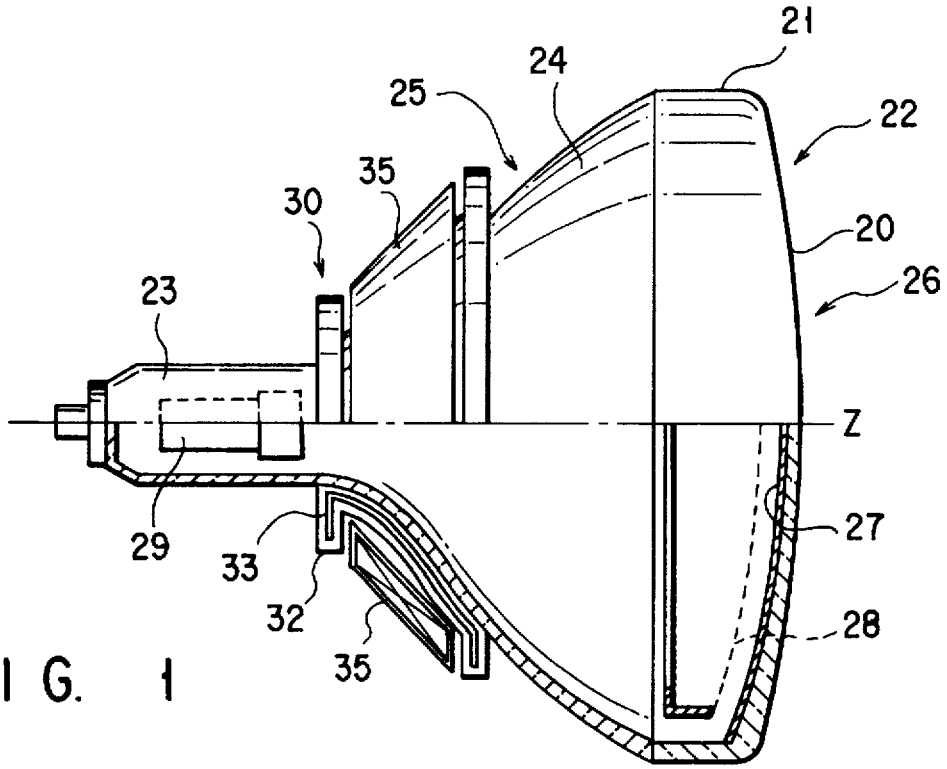

As shown in FIG. 1, the color cathode ray tube comprises a vacuum envelope 26 that includes a face panel 22 of glass and a funnel 25 bonded to the face panel. The panel 22 includes a substantially rectangular effective portion 20 and a skirt portion 21 set up on the peripheral edge of the effective portion. The funnel 25 has a cylindrical small-diameter neck 23 at one end portion thereof and a large-diameter cone 24 at the other end portion. At the other end of the funnel 25, the cone 24 has a substantially rectangular cross section that corresponds to the external shape of the skirt portion 21 of the face panel 22. The cone 24 is bonded to the skirt portion 21 of the panel 22.

As shown in FIGS. 3A to 3F, the funnel 25 of the envelope 26 is formed so that the cross-sectional shape of its region near the boundary between the neck 23 and the cone 24 gradually changes from a circular shape corresponding to the cylindrical neck 23 into a substantially rectangular (noncircular) shape that resembles the external shape of the skirt portion 21 of the face panel 22.

As shown in FIG. 1, the inner surface of the effective portion 20 of the face panel 22 is formed having a phosphor screen 27, which is composed of three phosphor layers that radiate individually in three colors, blue, green, and red. Arranged in the envelope 26, moreover, is a substantially rectangular shadow mask 28 that faces the inner surface of the phosphor screen 27. Further, an electron gun 29 is disposed in the neck 23 of the funnel 25. A deflection yoke 30 (mentioned later) is attached to the outside of the funnel 25 in the vicinity of the boundary between the neck 23 and the cone 24. Three electron beams emitted from the electron gun 29 are deflected in the horizontal and vertical directions by means of magnetic fields that are generated by the yoke 30, screened by means of the shadow mask 28, and then projected on the phosphor screen 27, whereupon a desired image is displayed on the screen.

Figure 2:
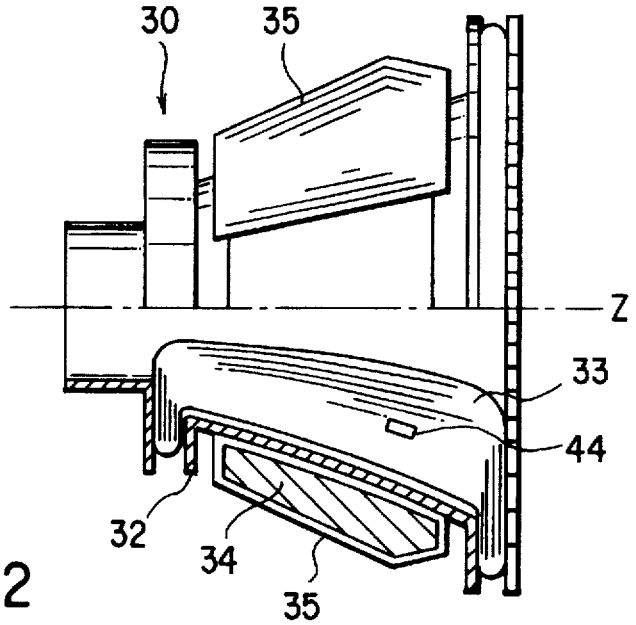
Figure 3A:
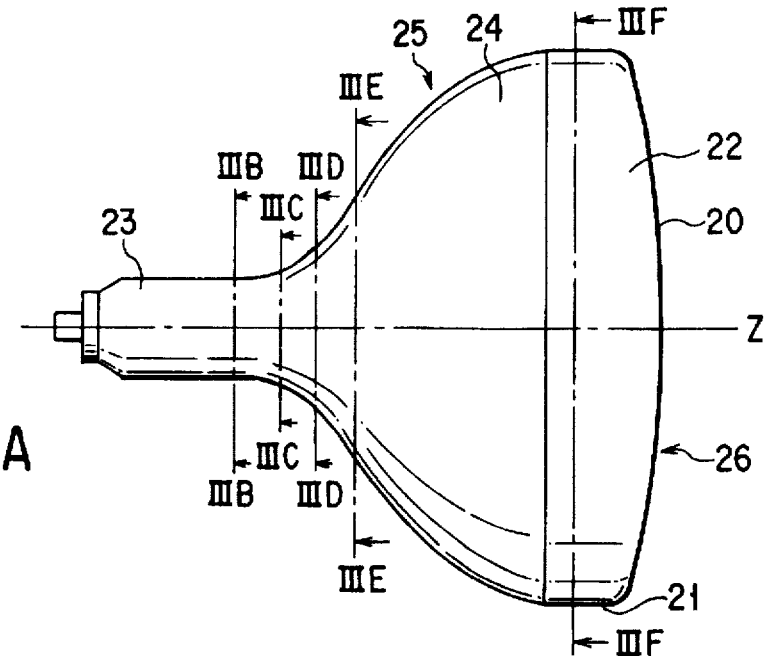
FIG. 3A is a plan view of a vacuum envelope of the color cathode ray tube.
Figure 3B:
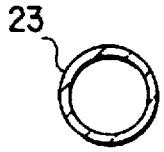
FIGS. 3B, 3C, 3D, 3E and 3F are sectional views taken along lines IIIB—IIIB, IIIC—IIIC, IIID—IIID, IIIE—IIIE and IIIF—IIIF, respectively, of FIG. 3A.
Figure 3C:
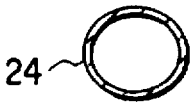
Figure 3D:
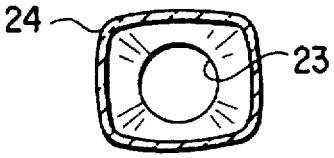
Figure 3E:
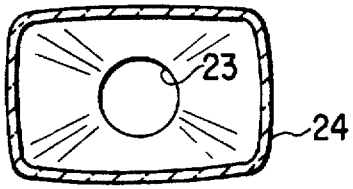
Figure 3F:
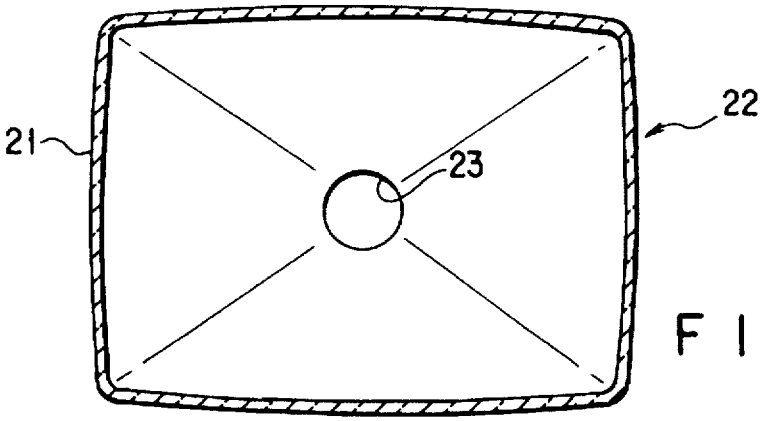

As shown in FIG. 2, the deflection yoke 30 includes a substantially trumpet-shaped separator 32 of a synthetic resin, a pair of saddle-type horizontal deflecting coils 33, a cylindrical core 34, and toroidal vertical deflecting coils 35. One end portion of the separator 32 on the side of the neck 23 of the funnel 25 has a small diameter, while the other end portion thereof on the side of the cone 24 has a large diameter. The horizontal coils 33 are arranged vertically symmetrically on the inner surface of the separator 32. The core 34 surrounds the outer surface of the separator 32. The vertical coils 35 are wound around the core 34 and arranged vertically symmetrically on the outer surface of the separator 32.

Figure 4:
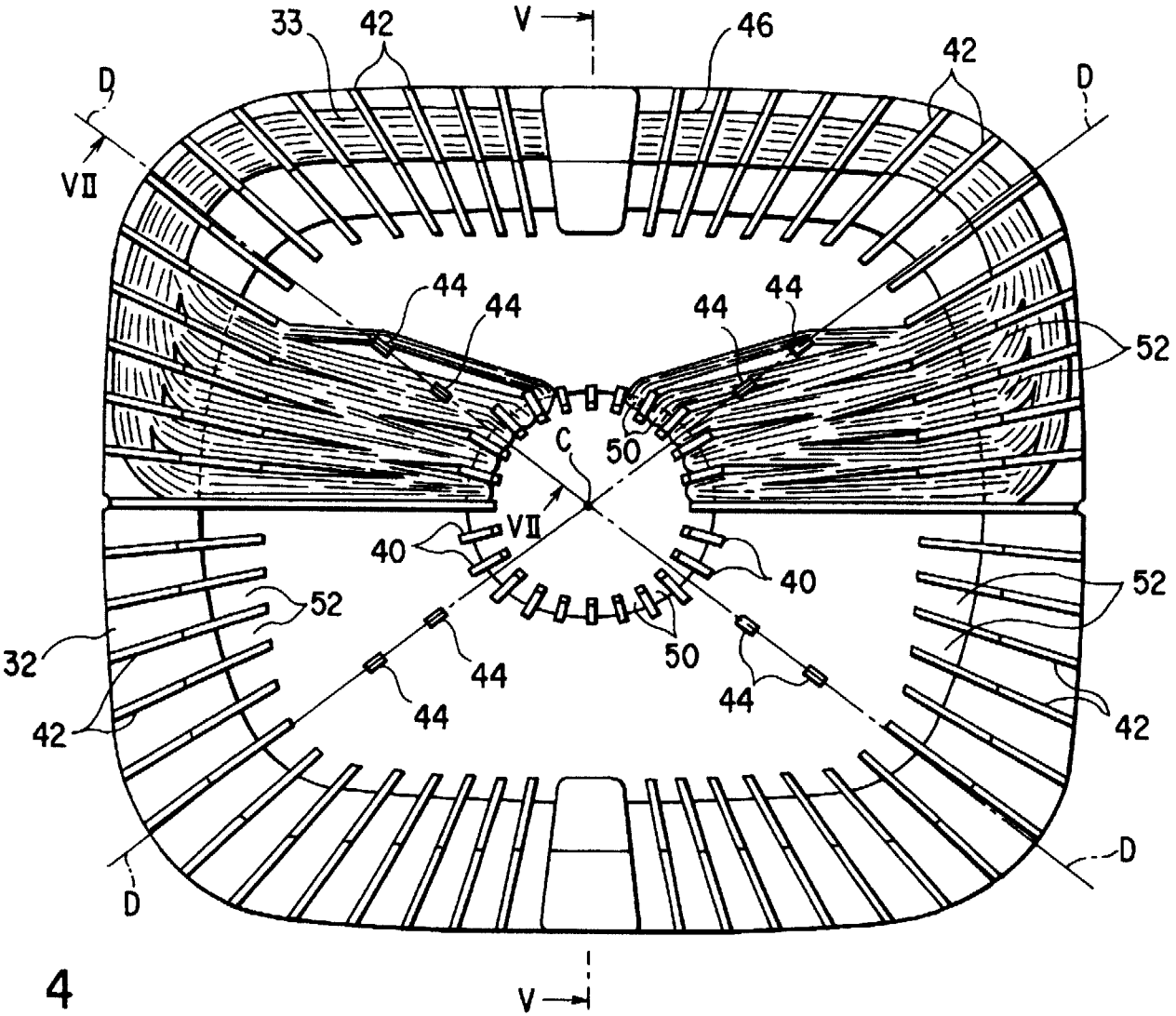
Figure 5:
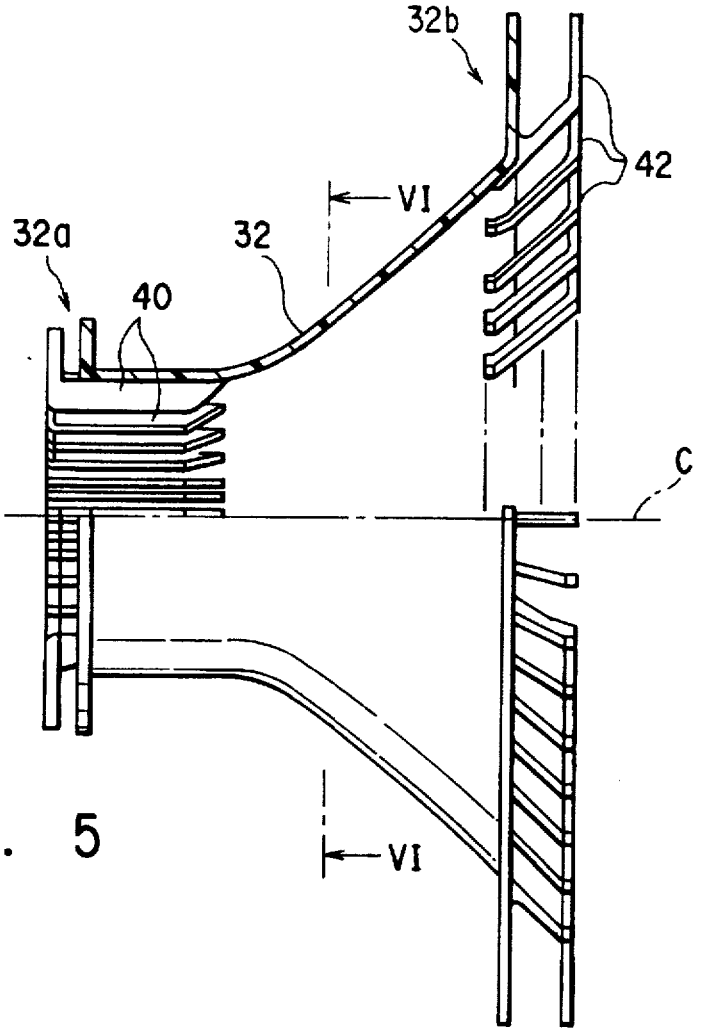
Figure 6:
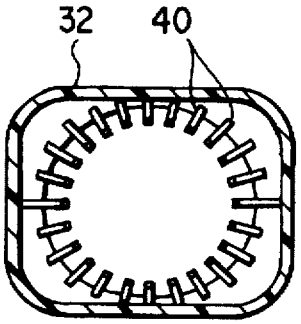

As shown in FIGS. 4, 5 and 6, the inner surface of the separator 32 has a shape that matches the shape of the outer surface of the funnel 25 of the vacuum envelope 26. More specifically, the inner surface of the separator 32 has a shape that corresponds to the external shape of the region near the boundary between the neck 23 and the cone 24 of the funnel 25 on which the deflection yoke 30 is mounted. One end portion **32*a* of the inner surface of the separator 32 on the neck side has a circular cross section. The cross-sectional shape of the separator 32** gradually changes from the circular shape at the one end portion into a substantially rectangular (noncircular) shape at the other end portion having a large diameter.

A large number of first hooks 40 are formed integrally on the inner surface of one end portion **32*a* of the separator 32, and extend in a direction substantially in parallel to the center axis c with substantially regular intervals in the circumferential direction of the one end portion 32*a*. Each first hook 40 is in the form of a plate that projects from the inner surface of the separator 32. An end portion of each first hook 40 projects from the one end portion 32***a* of the separator 32 and extends radially with respect to the central axis C of the separator.

Further, a large number of second hooks 42 are formed integrally on the inner surface of the other end portion 32*b* of the separator 32, and are arranged radially with respect to the central axis C of the separator and substantially at regular intervals in the circumferential direction of the other end portion 32*b*. Each second hook 42 is in the form of a plate that projects from the inner surface of the separator 32.

Figure 7:
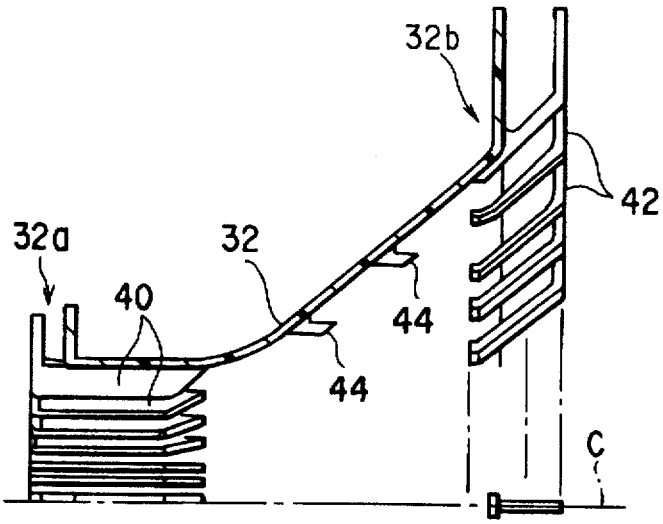

As shown in FIG. 7, moreover, the separator 32 is provided with a plurality of third hooks 44 in those regions of its inner surface whose cross sections are substantially rectangular in shape, that is, in the regions between the first and second hooks 40 and 42. More specifically, the third hooks 44 are located in those parts of the aforesaid regions whose cross sections have a minimum radius of curvature that is, in the vicinity of four diagonal axes D that extend through the corners of each substantially rectangular cross section. For example, each two of the third hooks 44 are arranged at a predetermined distance on each diagonal axis D.

As shown in FIG. 4, each of the two saddle-type horizontal deflecting coils 33 (only one of which is shown), which are arranged vertically symmetrically on the inner surface of the separator 32, is formed by coiling a winding 46 around the first and second hooks 40 and 42. The winding 46 is coiled in a manner such that it is anchored to the first and second hooks 40 and 42 and fitted in channels 50 defined between the adjacent first hooks 40 and channels 52 between the adjacent second hooks 42.

Those parts of the winding 46 which extend obliquely across the diagonal axes D on the inner surface of the separator 32 are caught by the third hooks 44.

According to the color cathode ray tube constructed in this manner, each horizontal deflecting coil 33 of the deflection yoke 30 is wound around the first and second hooks 40 and 42 that are formed on the opposite end portions of the inner surface of the separator 32, and is fitted in the channels 50 and 52 between the hooks. Thus, each horizontal deflecting coil 33 is mounted accurately in a predetermined position on the inner surface of the separator 32.

Further, those parts of the winding 46 of each horizontal deflecting coil 33 which extend across the diagonal axes D on the inner surface of the separator 32, that is, those parts of the inner surface of the separator 32 which extend across the minimum radius of curvature regions, are anchored to the third hooks 44 located in the vicinity of the diagonal axes D. Thus, the winding 46 can be securely prevented from being lifted off the inner surface of the separator 32 at the regions corresponding to the diagonal axes D, so that each horizontal deflecting coil 33 can be prevented from being dislocated.

The color cathode ray tube is designed so that the deflection yoke 30 having the aforementioned construction is mounted on the envelope 26, which is shaped so that the external shape of the region near the boundary between the neck 23 and the cone 24 of the funnel 25 gradually changes from the circular shape corresponding to the neck 23 into the substantially rectangular (noncircular) shape that resembles the external shape of the skirt portion 21 of the face panel 22. Thereupon, defection power can be reduced by bringing the horizontal and vertical deflecting coils 33 and 35 close to the paths of the electron beams, and the deflecting coils can be prevented from being dislocated and be held in correct positions. Thus, satisfactory image characteristics can be obtained without entailing disturbance in deflecting field distribution that is attributable to dislocation of the coils.

It is to be understood that the present invention is not limited to the embodiment described above, and that various changes and modifications may be effected therein by one skilled in the art without departing from the scope or spirit of the invention. For example, a pair of third hooks 44 are arranged projecting from the region near each diagonal axis D whose cross section has the minimum radius of curvature, in the intermediate portion of the inner surface of the separator 32 that is free of the channels 50 and 52. If necessary, however, the number of third hooks may be increased or reduced. For example, three or more third hooks may be arranged along each diagonal axis D. In this case, the degree of freedom for the regulation of the winding positions of the deflecting coils increases, so that the winding positions can be regulated more accurately than in the case of the foregoing embodiment.

Moreover, the deflection yoke described in connection with the foregoing embodiment is composed of the saddle-type horizontal deflecting coils and the toroidal vertical deflecting coils. However, the present invention may be also applied to a cathode ray tube wherein both horizontal and vertical deflecting coils of the deflection yoke are of the saddle type, with the same result.

Furthermore, the invention is applicable to a monochromatic cathode ray tube, as well as to the color cathode ray tube.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. A cathode ray tube comprising:

an envelope including a face panel having a substantially rectangular effective portion and a funnel fixed to the face panel, the funnel having a cylindrical small-diameter neck at one end portion thereof and a large-diameter cone at the other end portion, the cone having a substantially rectangular cross sectional shape corresponding to the external shape of the face panel; and a deflection yoke including a substantially trumpet-shaped separator having one end portion, smaller in diameter, and the other end portion, larger in diameter, and a deflecting coil provided at least on the inner surface of the separator, and mounted in a region near the boundary between the neck and the cone of the funnel;

the region near the boundary between the neck and the cone of the funnel being shaped so that the external shape thereof gradually changes from a circular shape on the neck side into a substantially rectangular shape on the cone side, the separator including:

the inner surface having a shape resembling the external shape of the region near the boundary between the neck and the cone of the funnel so that the cross-sectional shape of the inner surface is circular at the one end portion of the separator and noncircular at the other end portion and gradually changes from the circular shape on the one end side into the noncircular shape on the other end side, a plurality of first hooks provided on the inner surface at the one end portion and extending along a central axis of the separator, and a plurality of second hooks provided on the inner surface at the other end portion, directed toward the other end of the separator and extending away from the central axis of the separator, the deflecting coil including a winding mounted on the inner surface of the separator with being wound around the first and second hooks, the separator including third hooks located on those parts of the inner surface thereof in which the cross section of the noncircular portion has a minimum radius of curvature, and engaged with those parts of the winding of the deflecting coil which extend across regions having the minimum radius of curvature, for preventing the winding from being lifted off the inner surface of the separator.

2. A cathode ray tube according to claim 1, wherein said inner surface of the separator at the other end portion has a substantially rectangular sectional shape, and said third hooks are provided at each corner portion of the cross section of the substantially rectangular portion of the inner surface and located between the first and second hooks.

3. A cathode ray tube according to claim 1, wherein said separator has channels defined between two adjacent first hooks and between two adjacent second hooks, and the winding of the deflecting coil is fitted in the channels.

4. A cathode ray tube according to claim 1, wherein a plurality of said third hooks are arranged along the central axis of the separator on those parts of the inner surface of the separator of which the cross sections have a minimum radius of curvature.

* * * * *